US010906015B2

(12) United States Patent
Huang et al.

(10) Patent No.: US 10,906,015 B2
(45) Date of Patent: Feb. 2, 2021

(54) TRANSMISSION MECHANISM SUITABLE FOR DOUBLE ROTATING PAINT MIXING MACHINE

(71) Applicant: ZHENGZHOU SANHUA TECHNOLOGY & INDUSTRY CO., LTD., Henan (CN)

(72) Inventors: Song Huang, Henan (CN); Yaobin Xue, Henan (CN); Fuming Yuan, Henan (CN)

(73) Assignee: ZHENGZHOU SANHUA TECHNOLOGY & INDUSTRY CO., LTD., Henan (CN)

( * ) Notice: Subject to any disclaimer, the term of this patent is extended or adjusted under 35 U.S.C. 154(b) by 250 days.

(21) Appl. No.: 16/105,400

(22) Filed: Aug. 20, 2018

(65) Prior Publication Data

US 2019/0054434 A1 Feb. 21, 2019

(30) Foreign Application Priority Data

Aug. 18, 2017 (CN) ..... 2017 1 07125995

(51) Int. Cl.

| | |
|---|---|
| ***B01F 7/00*** | (2006.01) |
| ***B01F 7/16*** | (2006.01) |
| ***B01F 9/00*** | (2006.01) |
| ***B01F 15/00*** | (2006.01) |
| ***B01F 3/10*** | (2006.01) |

(52) U.S. Cl.

CPC ..... *B01F 7/161* (2013.01); *B01F 3/10* (2013.01); *B01F 7/00233* (2013.01); *B01F 9/0001* (2013.01); *B01F 15/00668* (2013.01); *B01F 15/00753* (2013.01); *B01F 2215/005* (2013.01)

(58) Field of Classification Search

CPC .. B01F 9/0001; B01F 7/161; B01F 2215/005; B01F 15/00668; B01F 15/00753; B01F 3/10; B01F 7/00233

See application file for complete search history.

(56) References Cited

U.S. PATENT DOCUMENTS 2,965,363 A * 12/1960 Worden ..... B01F 15/00454 366/197
5,261,744 A * 11/1993 Brunn ..... B01F 9/0001 366/217

(Continued)

FOREIGN PATENT DOCUMENTS

CN 101244370 A 8/2008

*Primary Examiner* — Anshu Bhatia

(74) *Attorney, Agent, or Firm* — Hamre, Schumann, Mueller & Larson, P.C.

(57) ABSTRACT

A transmission mechanism suitable for a double-rotating paint mixing machine, comprising a rotating spindle installed on a rack, a pressing spindle installed in the rotating spindle, a guide rail frame fixed at a front end of the rotating spindle, an upper supporting arm and a lower supporting arm, and an upper pressing disc and a lower pressing disc, which are installed on the upper supporting arm and the lower supporting arm and are capable of rotating, wherein the rotating spindle can drive the entire guide rail frame to rotate along the axis of the rotating spindle, meanwhile the upper pressing disc can be driven by a transmission system to rotate around its own axis at the same time, wherein the rotating spindle is engaged with and disengaged from the driving wheel through a driving disc locking device.

3 Claims, 10 Drawing Sheets

(56) References Cited

U.S. PATENT DOCUMENTS

| | | | | |
|---|---|---|---|---|
| 5,788,371 | A * | 8/1998 | Neri | B01F 9/0001 366/217 |
| 2005/0088911 | A1* | 4/2005 | Sordelli | B01F 15/00753 366/217 |
| 2005/0286341 | A1* | 12/2005 | Midas | B01F 9/0001 366/217 |

* cited by examiner

TRANSMISSION MECHANISM SUITABLE FOR DOUBLE ROTATING PAINT MIXING MACHINE

FIELD OF THE INVENTION

The present invention relates to a double-rotating mixing machine for coating, oil paint and the like, and in particular to a transmission mechanism capable of performing mixing after pressing a paint bucket on a double-rotating paint mixing machine.

BACKGROUND OF THE INVENTION

At present, mixing machines in the paint industry are divided into vibration mixing machines and rotating mixing machines (also known as rotary mixing machines). The present invention relates to a rotating mixing machine, and specifically relates to an automatic double-rotating mixing machine. The double-rotating mixing machine is a device that blends or mixes paint, oil paint and the like, and a bucket (referred to as a paint bucket in the present specification) accommodating the paint, the oil paint and the like can be driven to rotate around a rotating shaft vertical to the geometric centerline of a bucket while rotating around the geometric centerline of the paint bucket in the double-rotating mixing machine, namely performing both rotation and revolution, to achieve the purpose of double-rotating mixing of the paint. The invention patent with a patent number CN200810049422.2 relates to a transmission mechanism suitable for a double-rotating mixing machine, in the above prior art, the two independent tasks of separate rotation of a pressing spindle and synchronous rotation of the pressing spindle and a rotating spindle are controlled by the operation switching of an electromagnetic clutch device, the electromagnetic clutch device has many parts and components, and the cooperation between the parts and components is much, so that the fault rate of the cooperation between the parts and components is increased, and meanwhile the cost of the machine is increased accordingly. Therefore, how to reduce the parts and components of the double-rotating mixing machine to reduce the production cost without reducing or decreasing the functions of the double-rotating mixing machine becomes a technical problem to be solved urgently at present.

SUMMARY OF THE INVENTION

In view of the above-mentioned drawbacks of the prior art, the present invention provides a transmission mechanism suitable for a double-rotating paint mixing machine, and especially a transmission mechanism on a double-rotating paint mixing machine, which independently accomplishes two independent tasks of separate rotation of a pressing spindle and synchronous rotation of the pressing spindle and a rotating spindle through the driving of one motor by means of the operation of a driving disc locking device.

To solve the above technical problem, the technical solution adopted by the present invention is as follows:

A transmission mechanism suitable for a double-rotating paint mixing machine includes a rotating spindle installed on a rack, a pressing spindle installed in the rotating spindle, a guide rail frame fixed at a front end of the rotating spindle, an upper supporting arm and a lower supporting arm, which are arranged on the guide rail frame and capable of oppositely moving up and down along the same, and an upper pressing disc and a lower pressing disc, which are installed on the upper supporting arm and the lower supporting arm and are capable of rotating, wherein the rotating spindle can drive the entire guide rail frame to rotate along the axis of the rotating spindle, meanwhile the upper pressing disc can be driven by a transmission system to rotate around its own axis at the same time, the rotating spindle and the pressing spindle are driven by a same motor through a same driving wheel, the back end of the pressing spindle is fixedly connected with the driving wheel directly, and the rotating spindle is engaged with and disengaged from the driving wheel through a driving disc locking device.

The driving disc locking device is composed of a locking block installed on the rotating spindle, a locking gear installed on the pressing spindle and a push block installed on the rack, and a gear deflector rod is arranged on the locking block; the gear deflector rod is combined with the locking gear by inserting between teeth, and the rotating spindle and the pressing spindle are synchronously connected; the push block is in press fit with the locking block, the gear deflector rod is separated from the locking gear, the rotating spindle is fixed, and the pressing spindle is in a state of rotating separately; the push block is fixed to the rack through a slide rail, and a driving mechanism is arranged on the rack and connected with the push block; and the locking gear is located at the side of the locking block, the middle of the gear deflector rod is hinged on the locking block, a reset spring is arranged between one end of the gear deflector rod and the locking block, and the other end of the gear deflector rod is combined with the locking gear by inserting between teeth.

The driving mechanism is one of a pneumatic push rod, a hydraulic push rod, an electric push rod or a motor worm.

By adoption of the above technical solution, the present invention has the following beneficial effects:

The structure is simple, the design is reasonable, in the transmission mechanism on the double-rotating paint mixing machine, which independently accomplishes two independent tasks of separate rotation of the pressing spindle and synchronous rotation of the pressing spindle and the rotating spindle through the driving of one motor by means of the action of the driving disc locking device, the connecting structures, and parts and components of the double-rotating paint mixing machine are reduced without reducing or decreasing the functions of the double-rotating paint mixing machine, and the fault rate and the production cost of the double-rotating paint mixing machine are greatly reduced.

Figure 1:
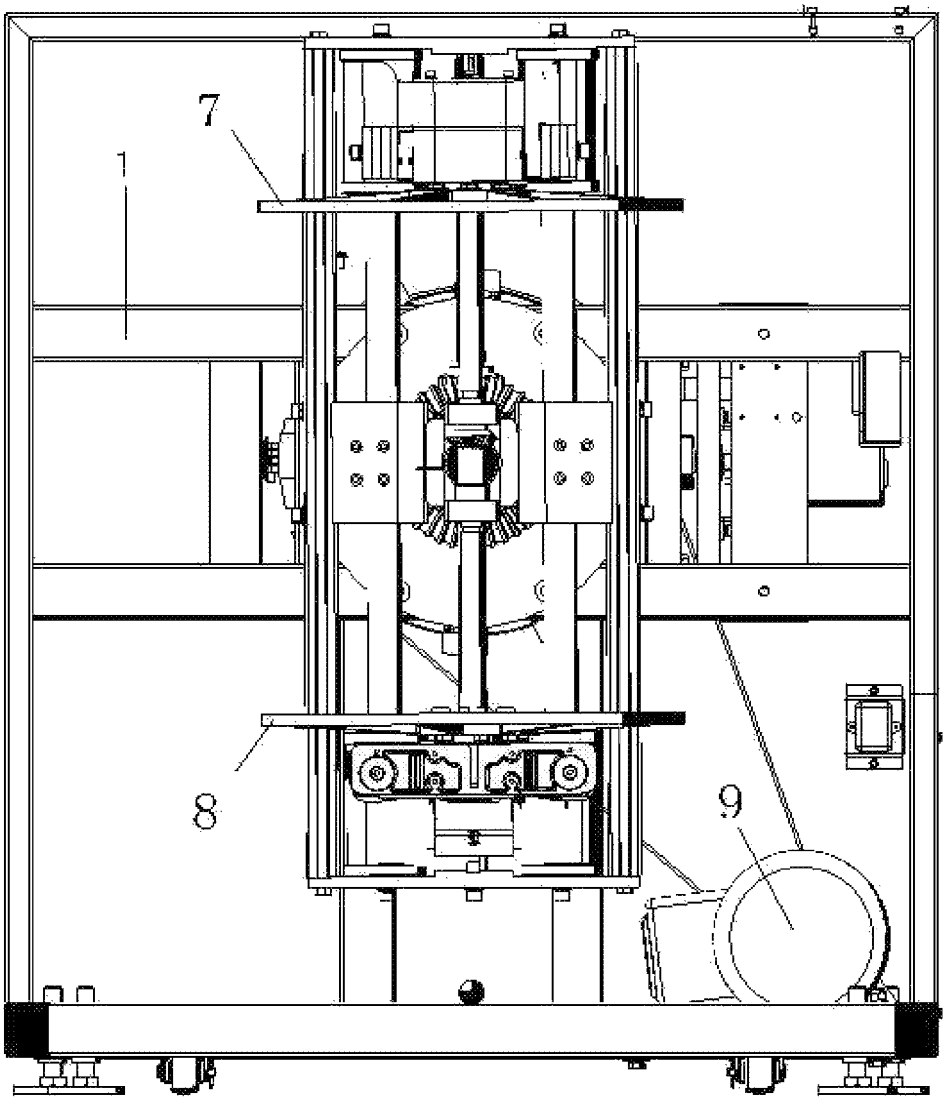
FIG. 1 is a schematic diagram of a top view structure of the present invention.
Figure 2:
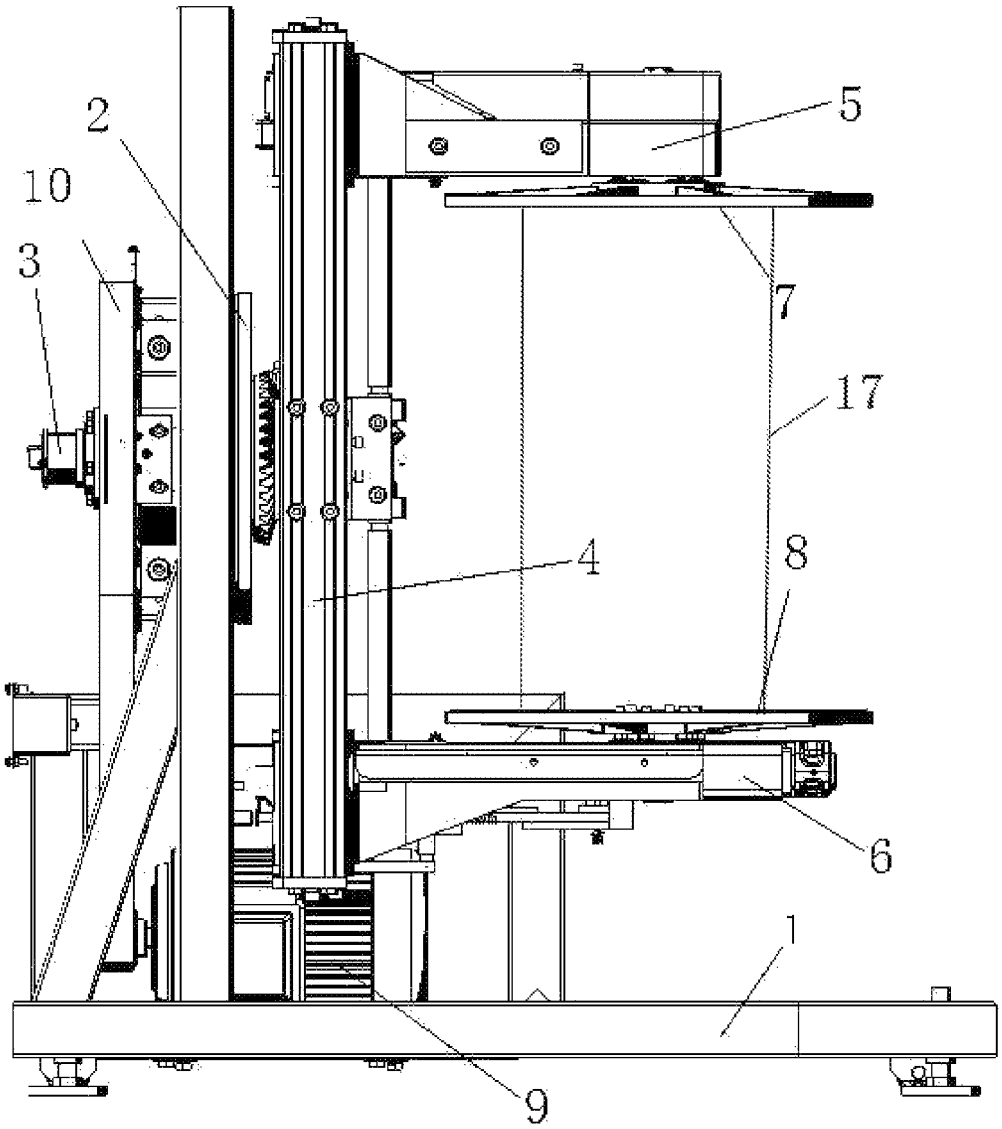
FIG. 2 is a schematic diagram of a left view structure of FIG. 1.
Figure 3:
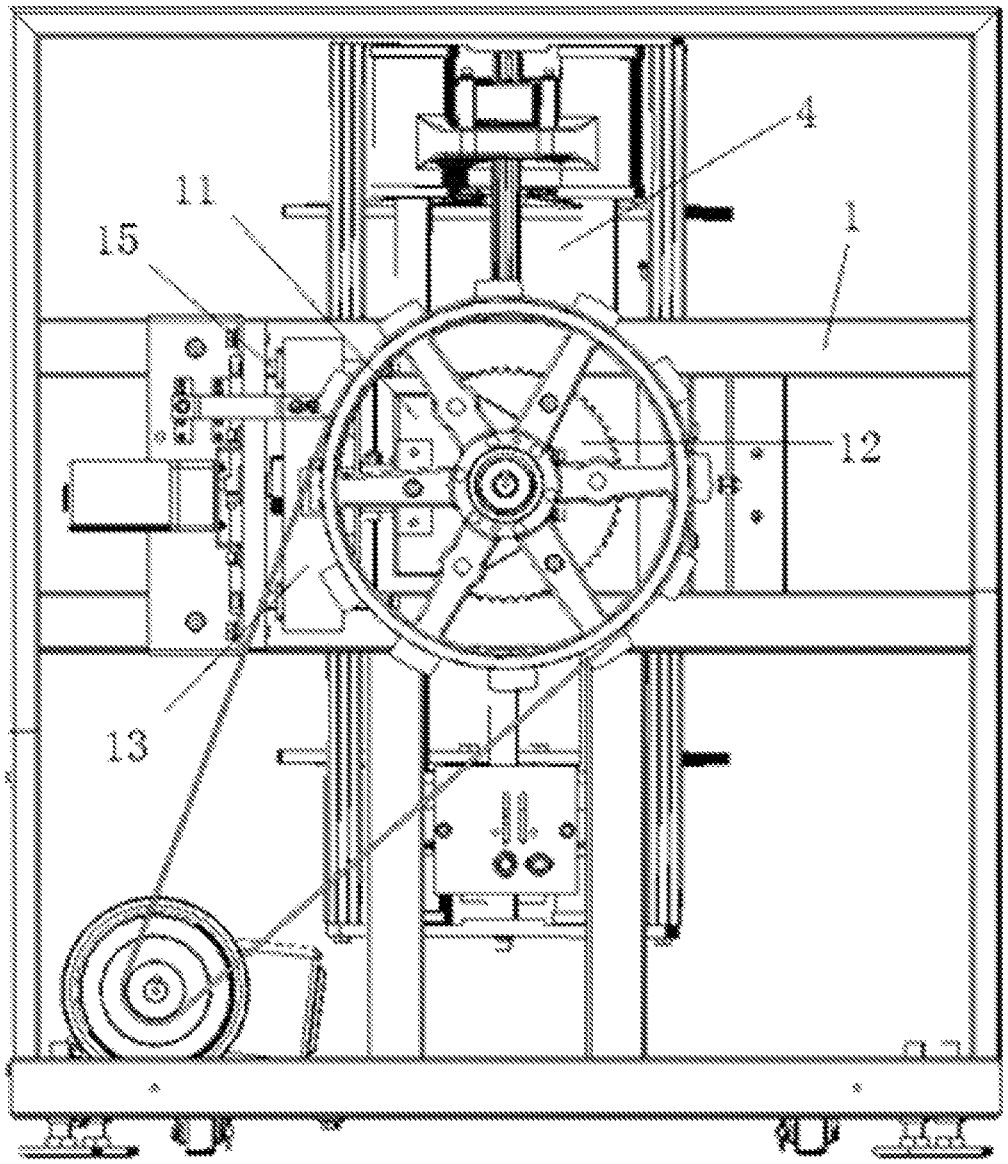
FIG. 3 is a schematic diagram of a rear view structure of FIG. 1.
Figure 4:
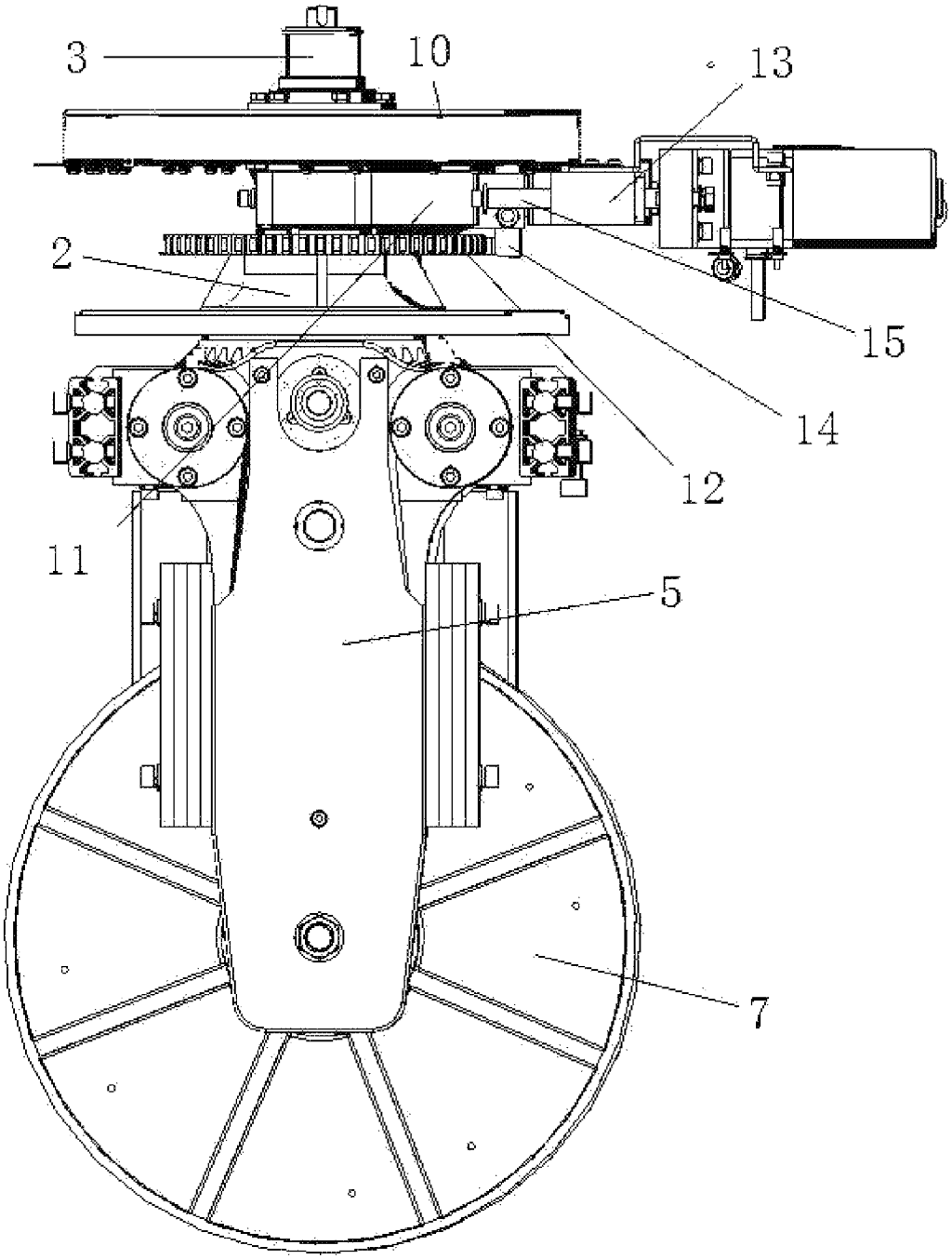
FIG. 4 is a schematic diagram of a top view structure of FIG. 1.
Figure 5:
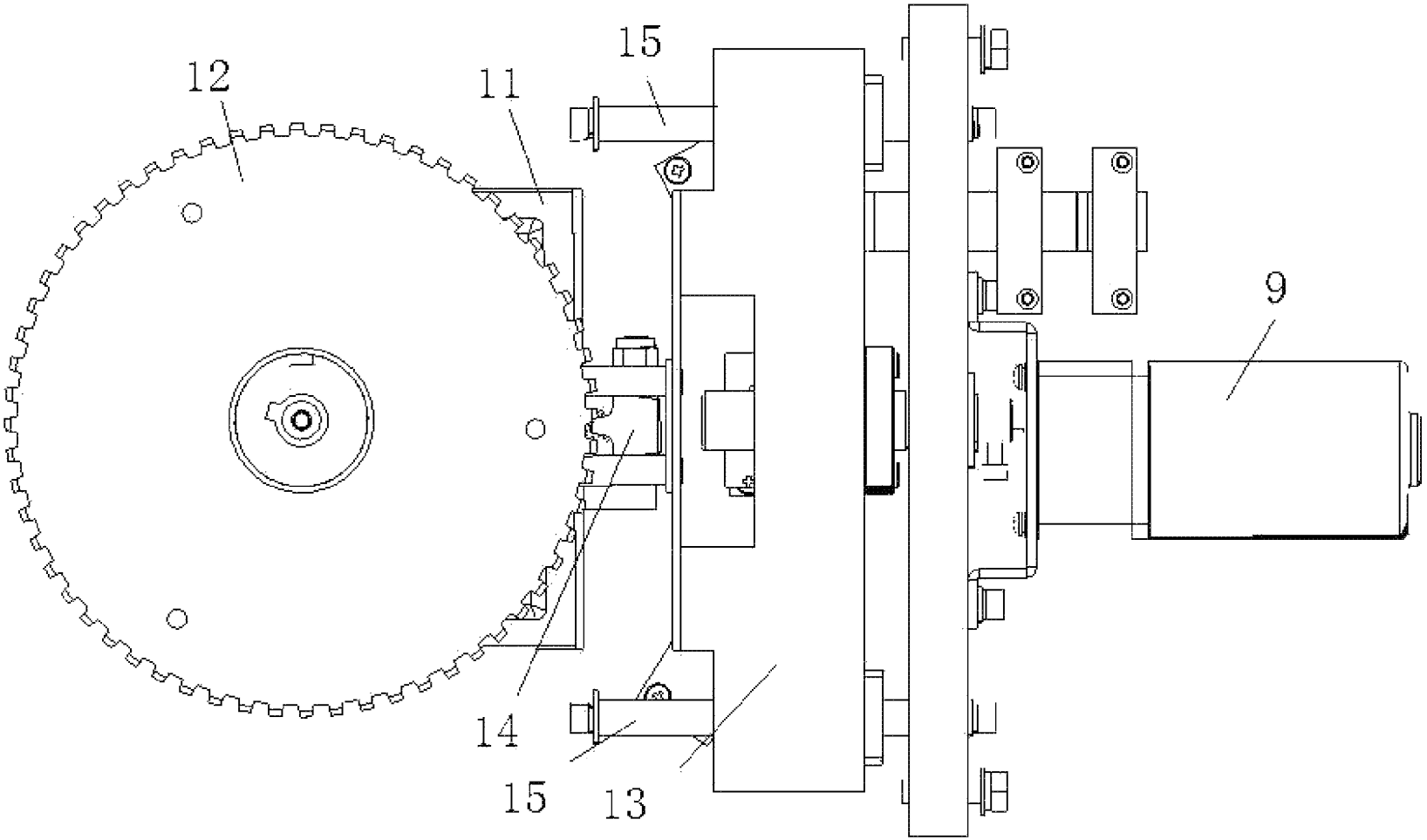
FIG. 5 is a structural schematic diagram of a driving disc locking device in the present invention.
Figure 6:
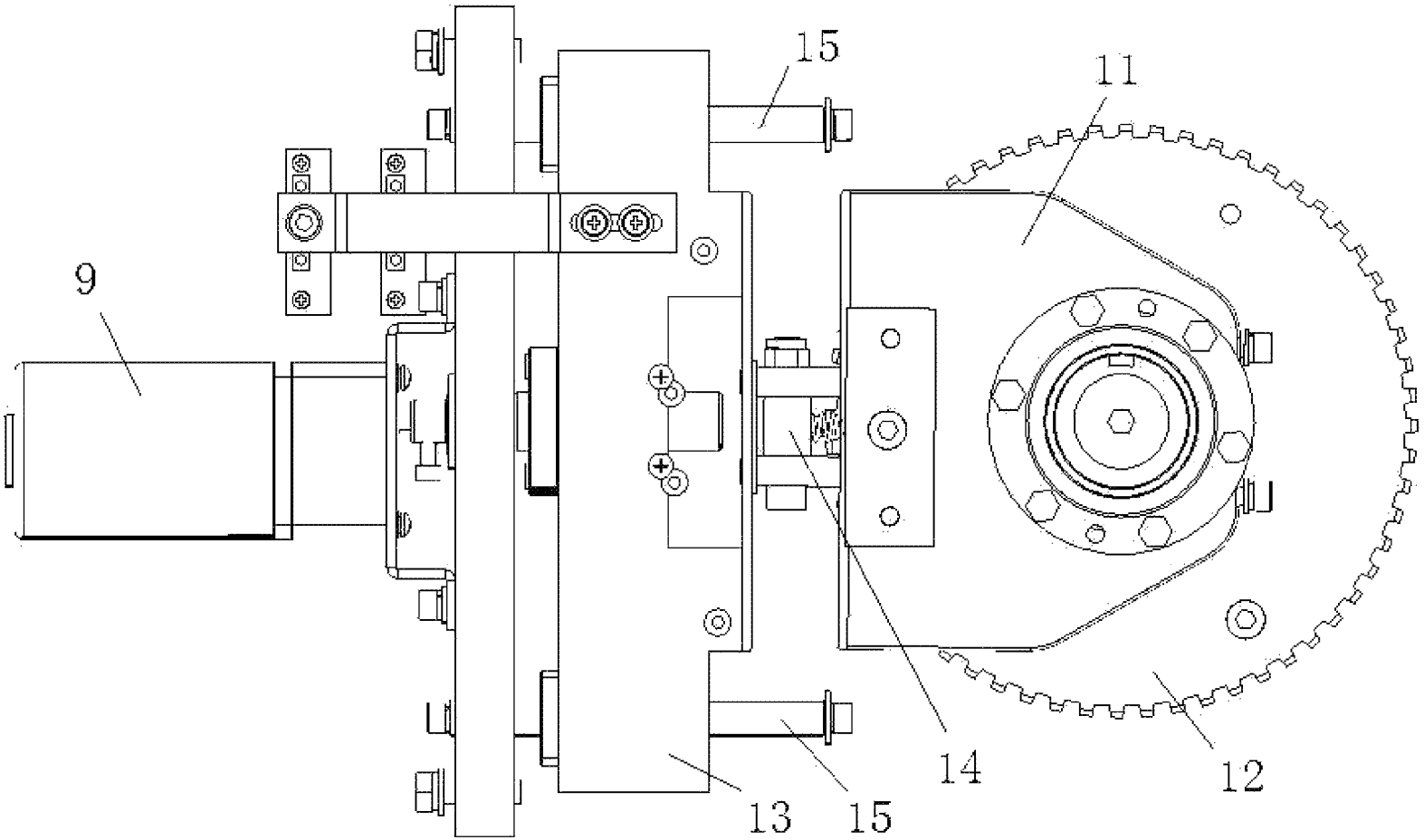
FIG. 6 is a schematic diagram of a rear view structure of FIG. 5.
Figure 7:
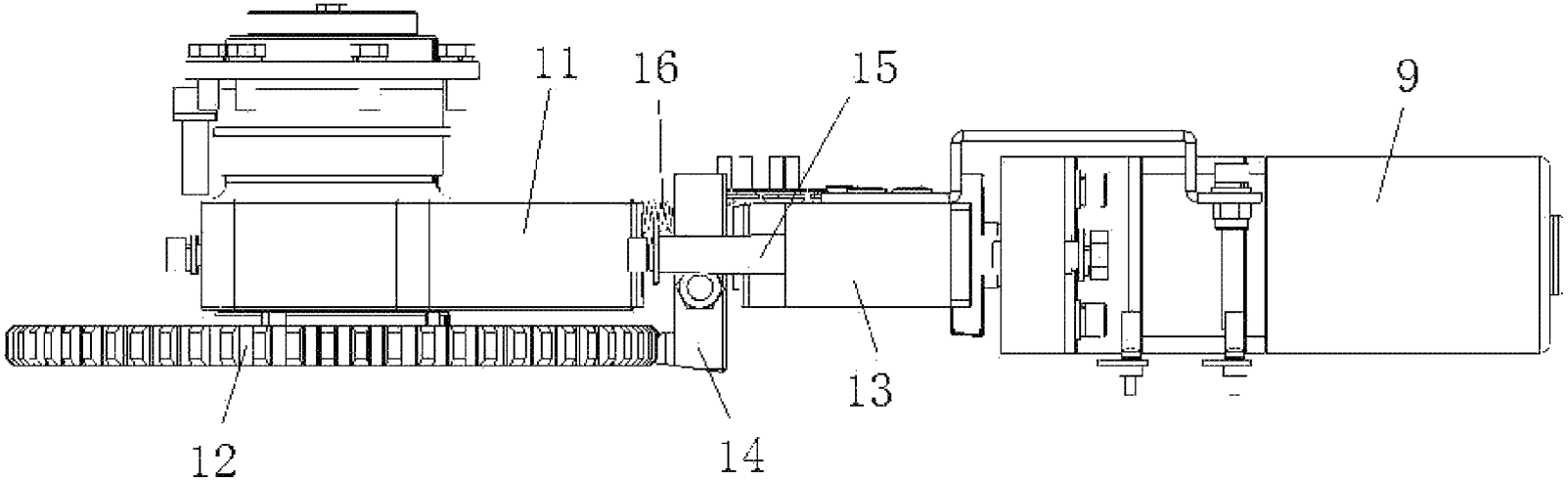
FIG. 7 is a schematic diagram of a top view structure of FIG. 5.

rack 1, rotating spindle 2, pressing spindle 3, guide rail frame 4, upper supporting arm 5, lower supporting arm 6, upper pressing disc 7, lower pressing disc 8, motor 9, driving wheel 10, locking block 11, locking gear 12, push block 13, gear deflector rod 14, slide rail 15, reset spring 1, paint bucket 17, large flange plate 18, large bevel gear 19, small bevel gear 20, guide shaft 21, driving belt pulley 22, belt 23, and driven belt pulley 24.

DETAILED DESCRIPTION OF THE EMBODIMENTS

The specific embodiments of the present invention are further described in detail below with reference to the accompanying drawings:

As shown in FIGS. 1 to 7, a transmission mechanism suitable for a double-rotating paint mixing machine includes a rotating spindle 2 installed on a rack 1, a pressing spindle 3 installed in the rotating spindle 2, a guide rail frame 4 fixed at a front end of the rotating spindle 2, an upper supporting arm 5 and a lower supporting arm 6, which are arranged on the guide rail frame 4 and capable of oppositely moving up and down along the same, and an upper pressing disc 7 and a lower pressing disc 8, which are installed on the upper supporting arm 5 and the lower supporting arm 6 and are capable of rotating; the rotating spindle 2 can drive the entire guide rail frame 4 to rotate along the axis of the rotating spindle 2, meanwhile the upper pressing disc 7 can be driven by a transmission system to rotate around its own axis at the same time, the rotating spindle 2 and the pressing spindle 3 are driven by a same motor 9 through a same driving wheel, the back end of the pressing spindle 3 is fixedly connected with the driving wheel 10 directly, and the rotating spindle 2 is driven by the driving wheel 10 through the control of a driving disc locking device.

The driving disc locking device is mainly composed of a locking block 11 installed on the rotating spindle 2, a locking gear 12 installed on the driving wheel 10 and a push block 13 installed on the rack 1, a gear deflector rod 14 is arranged on the locking block 11, the gear deflector rod 14 is combined with the locking gear 12 by inserting between teeth, and the rotating spindle 2 and the pressing spindle 3 synchronously rotate; and when the push block 13 is in press fit with the locking block 11 through a driving mechanism, the gear deflector rod 14 is separated from the locking gear 12, the rotating spindle 2 stops rotating, and the pressing spindle 3 rotates separately.

The push block 13 is fixed to the rack 1 through a slide rail 15, and the driving mechanism is arranged on the rack 1 and connected with the push block 13.

The locking gear 12 is located at the side of the locking block 11, the middle of the gear deflector rod 14 is hinged on the locking block 11, a reset spring 16 is arranged between one end of the gear deflector rod 14 and the locking block 11, the other end of the gear deflector rod 14 is combined with the locking gear 12 by inserting between teeth in an operating state, and the other end of the gear deflector rod 14 is separated from the locking gear 12 in a non-operating state.

The driving mechanism is one of a pneumatic push rod, a hydraulic push rod, an electric push rod or a motor worm transmission, and in the present invention, the motor worm transmission drives the push block 12 to reciprocate on the slide rail 15.

The working process of the present invention is as follows:

In embodiment 1, as shown in FIGS. 1 to 7, when a paint bucket 17 needs to be pressed, a coded disc for measuring the position and the rotating speed is installed on the driving wheel 10 at the same time, the rotation position and the rotating speed of the driving wheel 10 are measured by the coded disc, and the push block 13 is controlled to start moving forward at a proper time. The driving mechanism, namely, the pneumatic push rod, the hydraulic push rod, the electric push rod or the motor worm transmission, on the rack 1 pushes the push block 13 to press the locking block 11 forward on the slide rail 15, at this time, the rotating spindle 2 is locked, the push block 13 presses the locking block 11, meanwhile the reset spring 16 end between the locking block 11 and the gear deflector rod 14 is pressed by the push block 13 against the locking block 11, and the other end of the gear deflector rod 14 is separated from the locking gear 12, so that the rotating spindle 2 cannot rotate. The driving wheel 10 driven by the motor 9 can only drive the pressing spindle 3 installed in the rotating spindle 2 to rotate so as to provide transmission power for the opposite movement of the upper supporting arm 5 provided with the upper pressing disc 7 and the lower supporting arm 6 provided with the lower pressing disc 8. During the reverse rotation of the motor 9, after the sensor detects that the upper pressing disc 7 and the lower pressing disc 8 are separated for a certain distance, the motor stops rotating, and the paint bucket 17 to be mixed is placed on the lower pressing disc 8. After the machine door is closed, a start button is pressed, and the upper pressing disc 7 and the lower pressing disc 8 start pressing the paint bucket 17; once the paint bucket 17 is pressed, the driving mechanism, namely, the pneumatic push rod, the hydraulic push rod, the electric push rod or the motor worm transmission, on the rack 1 pulls back the push block 13 on the slide rail 15, the locking block 11 is separated from the push block 13, at this time, the rotating spindle 2 is unlocked, meanwhile, the other end of the gear deflector rod 14 on the locking block 11 is engaged with the locking gear 12 due to the push force on the end of the reset spring 16, the pressing spindle 3 and the rotating spindle 2 are connected into a whole, because the driving wheel 10 and the pressing spindle 3 are fixed together, at this time, the driving wheel 10, the rotating spindle 2 and the pressing spindle 3 meet a synchronous rotation condition to prevent the pressed paint bucket 17 from becoming loose during the subsequent rotation of the rotating spindle 2. At this time, the motor 9 is powered on to generate positive rotation to drive the driving wheel 10, the pressing spindle 3 and the rotating spindle 2, and the synchronous rotation of the pressing spindle 3 and the rotating spindle 2 is maintained to prevent the pressed paint bucket 17 from becoming loose.

Figure 10:
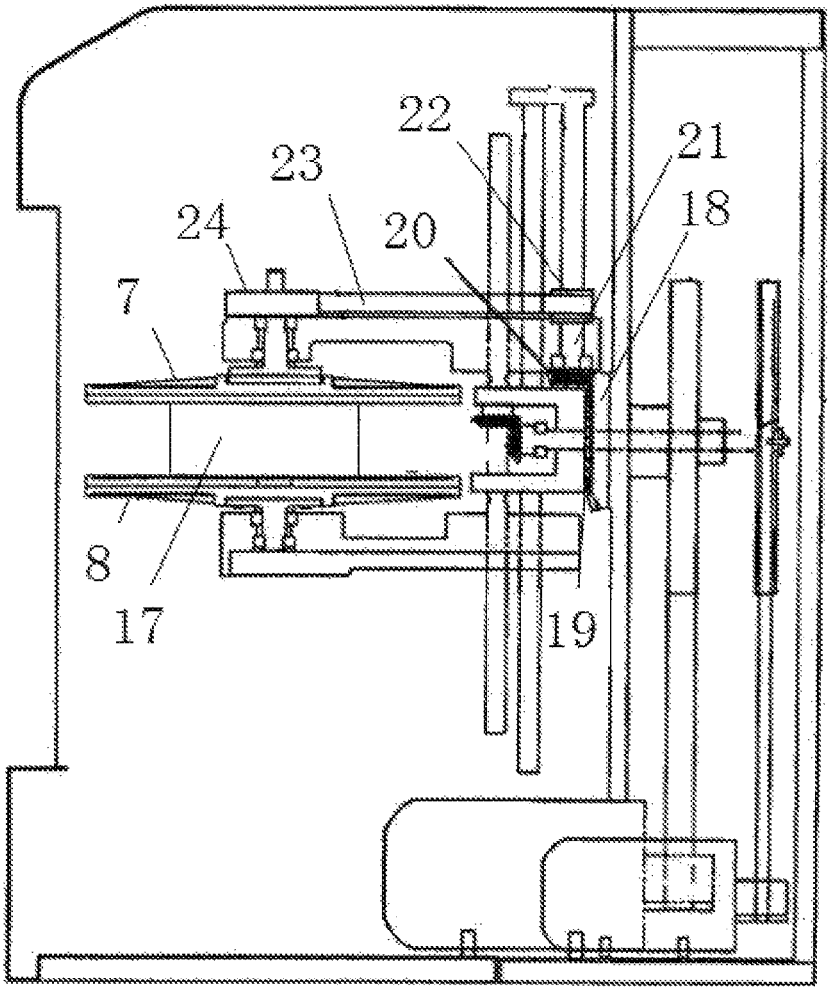
FIG. 10 is a structural schematic diagram of another view angle when both of an upper pressing disc and a lower pressing disc are non-circular discs in the present invention.

In addition, as shown in FIG. 10, another rotation transmission generated after the upper pressing disc 7 and the lower pressing disc 8 press the paint bucket 17 is from the rotation of a large bevel gear 19 on a large flange plate 18, a small bevel gear 20, a guide shaft 21 and a driving belt pulley 22, to a belt 23 along with the rotation of the guide shaft 21, the upper pressing disc 7 on a driven belt pulley 24 to the paint bucket 17. This transmission causes the paint bucket 17 to rotate around its own axis, that is, the paint bucket 17 generates mixed rotation around two mutually vertical directions within a specified time, that is, revolution and rotation. The paint in the bucket generates effective mixed rotation accordingly, thereby achieving the purpose of blending and mixing the paint.

Figure 8:
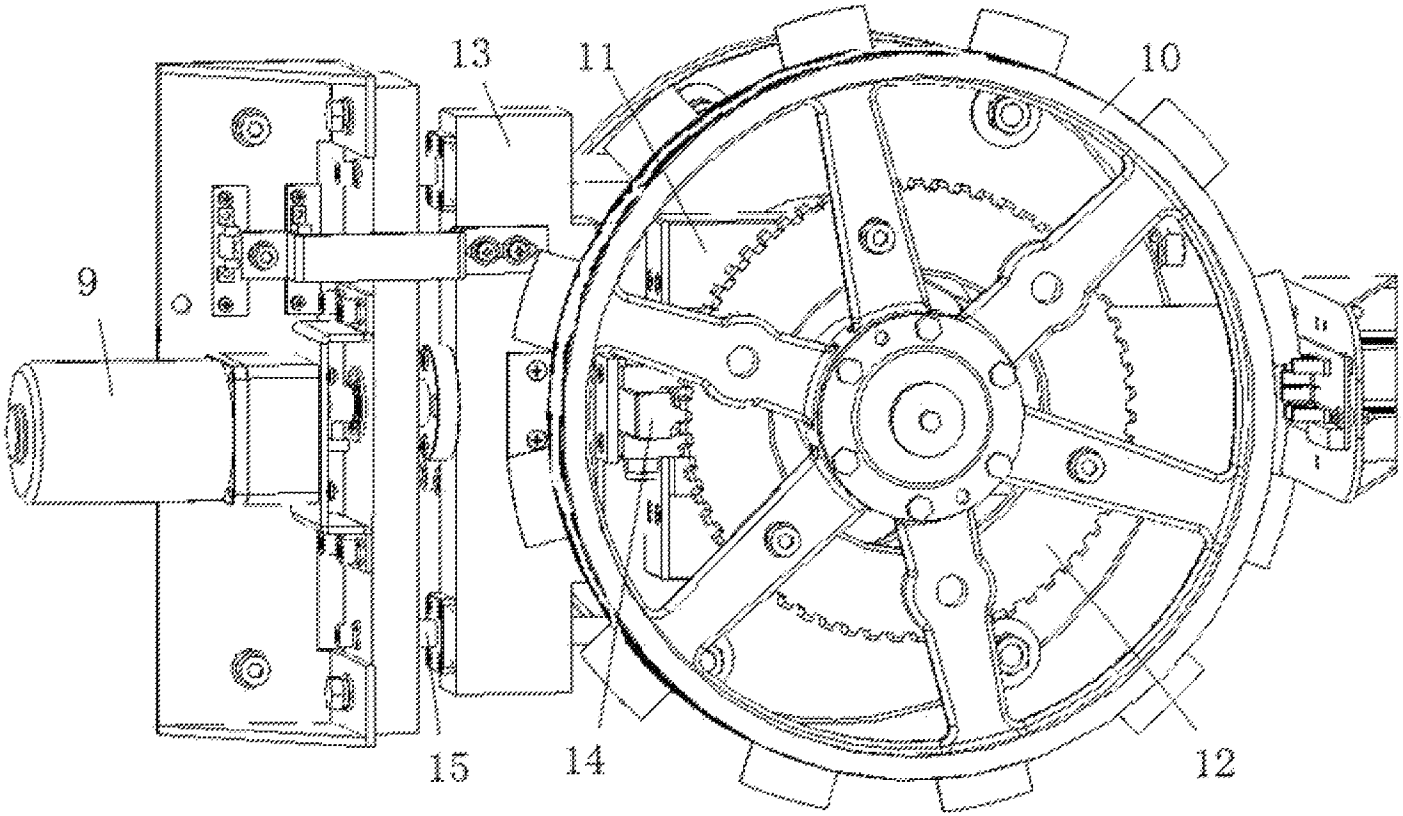
FIG. 8 is a structural schematic diagram of an embodiment of the present invention.

In embodiment 2, as shown in FIG. 8, the locking gear 12 is arranged on one side of the driving wheel 10, the locking gear 12 is set as an outer gear, the working position of the gear deflector rod 14 is set to be consistent with the locking gear 12, and the above operations can also be accomplished.

Figure 9:
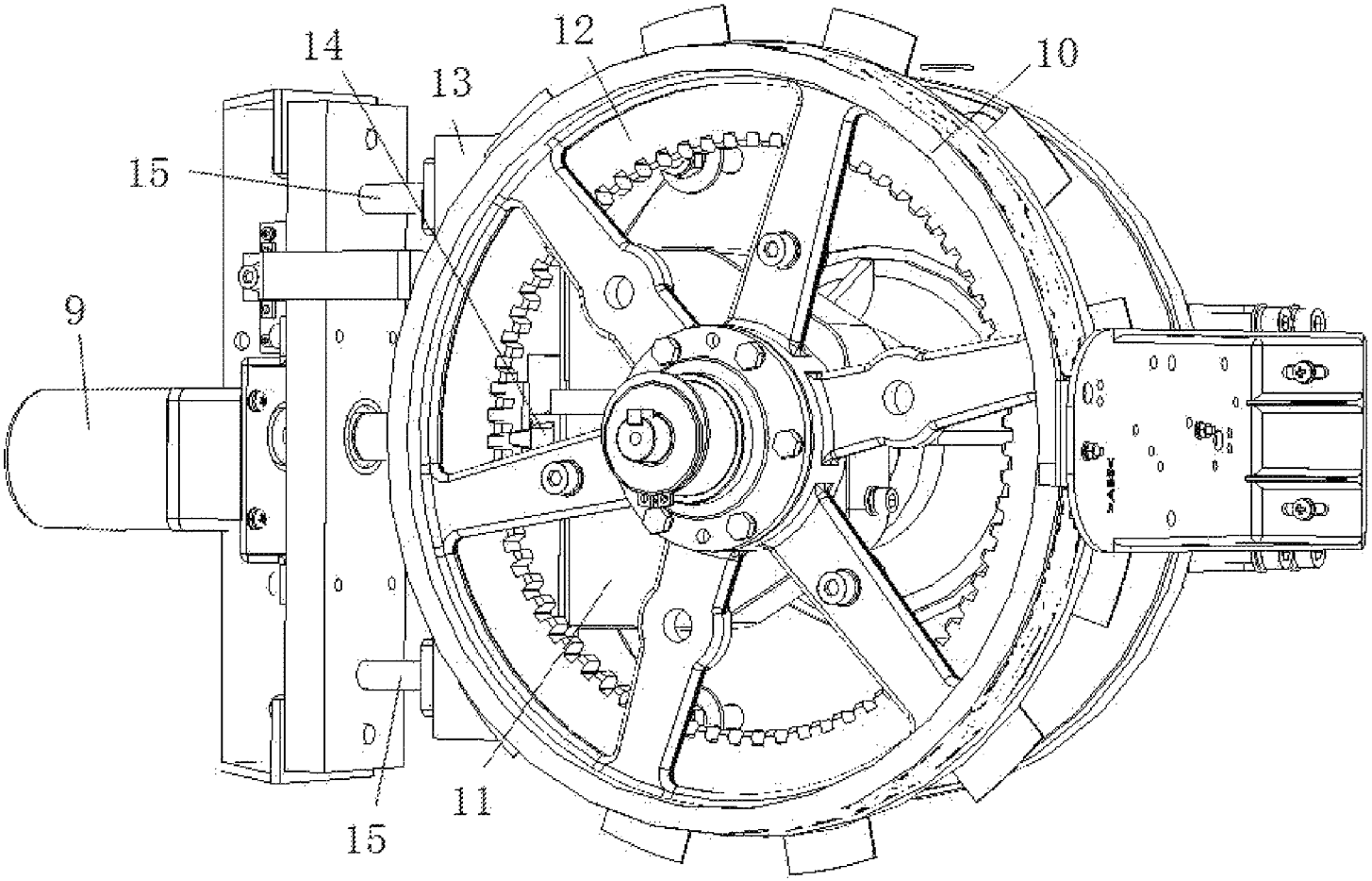
FIG. 9 is a structural schematic diagram of an embodiment of the present invention.

In embodiment 3, as shown in FIG. 9, the locking gear 12 is arranged on one side of the driving wheel 10, the locking gear 12 is set as an inner gear, the working position of the gear deflector rod 14 is set to be consistent with the locking gear 12, when the push block 13 presses the locking block 11, the inner tooth engagement ends of the gear deflector rod 14 and the locking gear 12 are pressed apart and separated to cooperate with the above components, and the above operations can also be accomplished.

The shape, material, structure and the like present invention are not limited to any form in the present embodiment, and any simple modifications, equivalent changes and modifications of the above embodiments made according to the technical essence of the present invention all belong to the protection scope of the technical solution of the present invention.

The invention claimed is:

1. A transmission mechanism suitable for a double-rotating paint mixing machine, comprising:

a rotating spindle installed on a rack;

a pressing spindle installed in the rotating spindle;

a guide rail frame fixed at a front end of the rotating spindle;

an upper supporting arm and a lower supporting arm, which are arranged on the guide rail frame and capable of oppositely moving up and down along the guide rail frame; and an upper pressing disc and a lower pressing disc, which are installed on the upper supporting arm and the lower supporting arm and are capable of rotating, wherein the rotating spindle can drive the entire guide rail frame to rotate along the axis of the rotating spindle, meanwhile the upper pressing disc can be driven by a transmission system to rotate around its own axis at the same time, the rotating spindle and the pressing spindle are driven by a same motor through a same driving wheel, and the back end of the pressing spindle is fixedly connected with the driving wheel directly, wherein the rotating spindle is engaged with and disengaged from the driving wheel through a driving disc locking device, the driving disc locking device comprising a locking block installed on the rotating spindle, a locking gear installed on the pressing spindle, and a push block installed on the rack, a gear deflector rod being arranged on the locking block, wherein the gear deflector rod is combined with the locking gear by inserting between teeth, the rotating spindle and the pressing spindle to be synchronously connected, and when the push block is in press fit with the locking block, the gear deflector rod is separated from the locking gear, the rotating spindle is fixed, and the pressing spindle is in a state of rotating separately.

2. The transmission mechanism suitable for the double-rotating paint mixing machine according to claim 1, wherein the push block is fixed to the rack through a slide rail, and a driving mechanism is arranged on the rack and connected with the push block, and the locking gear is located at the side of the locking block, the middle of the gear deflector rod is hinged on the locking block, a reset spring is arranged between one end of the gear deflector rod and the locking block, and the other end of the gear deflector rod can be combined with the locking gear by inserting between the teeth.

3. The transmission mechanism suitable for the double-rotating paint mixing machine according to claim 2, wherein the driving mechanism is one of a pneumatic push rod, a hydraulic push rod, an electric push rod or a motor worm.

* * * * *